United States Patent [19]

Suzuki

[11] Patent Number: 4,632,001

[45] Date of Patent: Dec. 30, 1986

[54] POLYPHONIC ELECTRONIC MUSICAL INSTRUMENT PERFORMING D/A CONVERSION OF TONE WAVESHAPE DATA

[75] Inventor: Hideo Suzuki, Hamamatsu, Japan

[73] Assignee: Nippon Gakki Seizo Kabushiki Kaisha, Hamamatsu, Japan

[21] Appl. No.: 601,296

[22] Filed: Apr. 17, 1984

[30] Foreign Application Priority Data

Apr. 20, 1983 [JP] Japan ..... 58-68434

[51] Int. Cl.[4] ..... G10H 1/18

[52] U.S. Cl. ..... 84/1.01; 340/365 S

[58] Field of Search ..... 84/1.01, 1.24; 340/365 S

[56] References Cited

U.S. PATENT DOCUMENTS 3,639,913 2/1972 Watson ..... 84/1.01 X
4,134,320 1/1979 Oya ..... 84/1.24
4,134,321 1/1979 Woron ..... 84/1.24
4,409,876 10/1983 Katoh ..... 84/1.01
4,539,883 9/1985 Chihana ..... 84/1.01 X

*Primary Examiner*—S. J. Witkowski
*Attorney, Agent, or Firm*—Spensley, Horn, Jubas & Lubitz

[57] ABSTRACT

A tone generation circuit can generate digital tone signals in a plurality of channels on a time shared basis and these digital tone signals are supplied to a digital-to-analog converter provided commonly for the respective channels. The digital-to-analog converter converts the digital tone signals of the respective channels into analog signals individually for each of the channels in the time division multiplexed state. Analog memory circuits are provided for the respective channels for demultiplexing and individually holding the time division multiplexed analog tone signals supplied from the digital-to-analog converter. The analog tone signals held in the respective analog memory circuits are individually read out in synchronism with pitches of notes assigned to the respective channels. An analog adder is provided, when required, for summing up the read out analog tone signals of the respective channels.

15 Claims, 6 Drawing Figures

POLYPHONIC ELECTRONIC MUSICAL INSTRUMENT PERFORMING D/A CONVERSION OF TONE WAVESHAPE DATA

BACKGROUND OF THE INVENTION

This invention relates to a polyphonic electronic musical instrument of a type which produces a tone by converting tone waveshape data generated in digital into an analog signal and, more particularly, to an electronic musical instrument of such type in which construction of a digital-to-analog conversion circuit is simplified and an aliasing noise, which may be caused in produced tones by processing waveshape sample point data of a tone, is removed by a relatively simple construction.

In typical prior art polyphonic type electronic musical instruments as shown for instance in the U.S. Pat. No. 4,409,876, particularly its FIG. 5, digital tone signals for plural channels are generated in time division, digital tone signals of all channels in one sample point are added together in a digital accumulator and the added digital tone signals are converted into analog signals by a digital-to-analog converter (hereinafter called D/A converter) and thereafter are supplied to a sound system. Such construction, however, has the disadvantage that the accumulator must be composed of a digital circuit to add digital signals of multiple bits together resulting in a large hardware structure. Besides, since the D/A converter receives a sum of tone signals for plural channels provided by the accumulator (which necessarily becomes a multiple bit data), the D/A converter must be a large one of a multiple input type.

Furthermore, in the above described type of electronic musical instrument which generates digital tone signals for plural channels in time division, the sampling frequency corresponding to the time division timing and the tone frequency are generally non-harmonic with each other and, accordingly, an aliasing noise which is non-harmonic with the tone frequency is produced as will be apparent from the sampling theorem. Some arrangement must be made to eliminate this aliasing noise and, in the prior art electronic musical instrument, the arrangement was made by a digital circuit with a result that the circuit construction becomes large and complicated.

SUMMARY OF THE INVENTION

It is, therefore, an object of the present invention to simplify the hardware structure of the D/A conversion circuit in a digital polyphonic type electronic musical instrument.

It is another object of the invention to simplify the hardware structure of the tone adding circuit by simplifying the D/A conversion circuit.

It is another object of the invention to remove a time division sampling clock component which is non-harmonic with the tone by a relatively simple construction and thereby eliminating the aliasing noise.

It is still another object of the invention to enable the electronic musical instrument to employ a low cost D/A converter by reducing necessity for high speed processing of the D/A converter. In a case where the channel time division rate is made high in order to increase the processing efficiency of the digital circuit, the D/A converter also is required to operate at a high time division rate and such D/A converter naturally is expensive. The invention aims at resolving this problem, too.

For achieving these objects, the electronic musical instrument of the invention does not employ the digital accumulator but applies digital tone signals supplied by tone generation means in a time division multiplexed state directly to a D/A converter which is common to respective channels thereby effecting D/A conversion of the signals individually for the respective channels in the time division multiplexed state. By this arrangement, the D/A converter receives not a sum of plural tones but a digital amplitude value for a single tone so that the number of input bits of the D/A converter is reduced and the circuit construction thereby is simplified. This enables addition to analog tone signals of respective channels by an analog adder (accumulator) if necessity arises. Since the analog accumulator is simpler in construction than the digital accumulator having multiple bit input and output terminals, the simplification of the hardware structure can be realized.

According to another aspect of the invention, a plurality of analog memories are provided in correspondence to the respective channels and analog amplitude signals for the respective channels supplied in time division from the D/A converter are sampled channel by channel (i.e., demultiplexed) and individually held. Thus, the time division multiplexed analog amplitude signals for the respective channels are parallelized and sustained. The memory contents of these analog memories may be read out always in parallel and a sustained manner. For achieving the other object of the invention, however, reading means may be further provided for individually reading out the respective analog amplitude signals held in the analog memories of the respective channels in synchronism with note pitches assigned to the respective channels. For example, the reading in synchronism with the pitch is made by effecting reading in synchronism with change in phase data for the respective channels. Thus, by effecting reading of the analog tone amplitude signals in synchronism with the note pitches assigned to the respective channels, the time division sampling clock component which is non-harmonic with the tone can be removed whereby the aliasing noise can be removed. Besides, the analog memories and the reading circuits can be made of a very simple construction consisting, for example, of capacitors and analog gates.

According to another aspect of the invention, phase data of tones assigned to the respective channels are generated in time division at a predetermined first time division rate (high rate time division timing) and this time division rate for the phase data is converted into a second time division rate (low rate time division timing) which is lower than the first time division rate. In the tone generation circuit, tone waveshape sample amplitude data is generated in digital in time division for the respective channels in accordance with the phase data which has been converted to low rate one. In the above described manner, the digital tone amplitude data for the respective channels generated in time division at the low time division rate is converted to analog data in the time division multiplexed state and thereafter the analog tone signals for the respective channels are added together for synthesizing, when necessary, by sampling and holding.

BRIEF DESCRIPTION OF THE DRAWINGS

In the accompanying drawings.

DETAILED DESCRIPTION OF PREFERRED EMBODIMENTS

An embodiment of the present invention will now be described with reference to the accompanying drawings.

Figure 1:
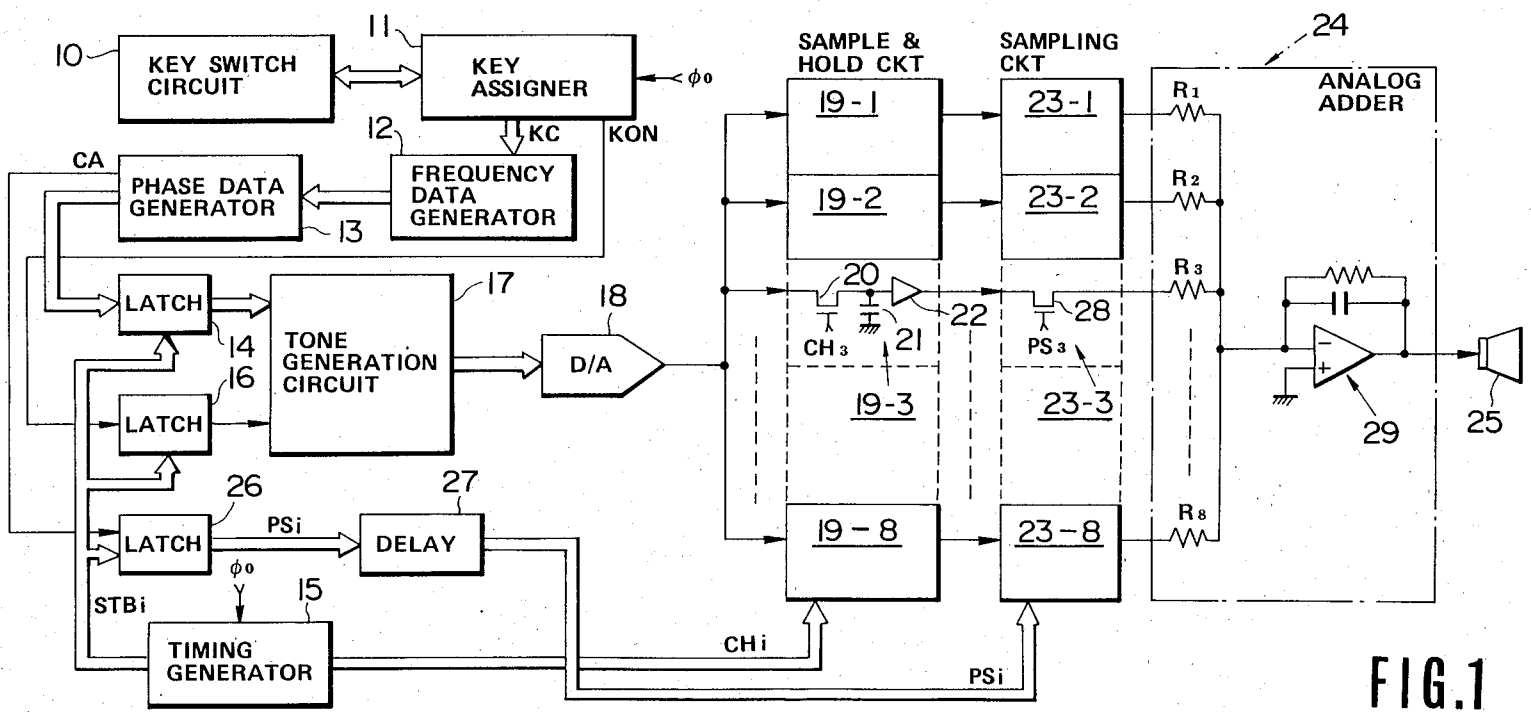
FIG. 1 is a block diagram of an embodiment of the electronic musical instrument according to the invention.

Referring to FIG. 1, a key switch circuit 10 includes key switches corresponding to respective keys of the keyboard. A key assigner 11 assigns a depressed key to one of a specified number of tone generation channels according to the output of the key switch circuit 10. The key assigner 11 produces a key code KC representing the key assigned to the specific channel and a key-on signal KON indicating whether said depressed key is still depressed or has been released in time division in synchronism with a given time division channel timing. A frequency data generator 12 produces data which indicates the tone frequency according to the key code KC supplied from the key assigner 11. A phase data generator 13 produces phase data based on the frequency data supplied from the frequency data generator 12. The phase data indicates the instantaneous phase which changes at a rate corresponding to that frequency.

Figure 2:
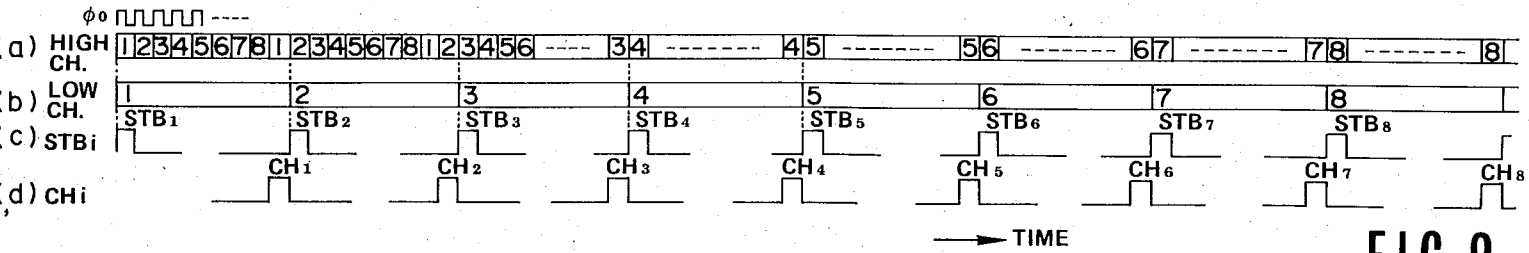
FIGS. 2(*a*)–(*d*) are time charts relating to the time division rate change operation in FIG. 1.

FIG. 2(*a*) shows an example of the time division channel timing of the key code KC and the key-on signal KON produced by the key assigner 11 (8 channels in this example). One slot according to this timing synchronizes with one period of the system clock pulse $\phi_0$. The time division timing of the phase data produced by the phase data generator 13 in the respective channels is the same as shown in FIG. 2(*a*).

A time division rate change latch circuit 14 is provided to change the time division rate of the phase data of each channel produced by the phase data generator 13 to a lower rate timing (e.g. as shown in FIG. 2(*b*)) than that shown in FIG. 2(*a*). To control this timing conversion to a low rate, a timing generator 15 produces a plurality of strobe pulses $STB_i$ (i=1, 2, 3, . . . 8) synchronizing with the low rate time division timings of the respective channels. As shown in FIG. 2(*c*), the strobe pulses $STB_1$–$STB_8$ corresponding to the respective channels are generated in a given time period (every time per 9 time slots) so that one strobe pulse is in the period of one cycle of the low rate time division timing coinciding with the corresponding time slots of the high rate time division channels. When supplied with the strobe pulse $STB_i$ of a certain channel, the latch circuit 14 latches the phase data of the high rate time division timing corresponding to that channel and holds the phase data it has latched for a given time period (9 time slots) until it is supplied with the strobe pulse $STB_i$ of the next channel. The phase data of the respective channels is thus converted in its time division rate to a low rate time division timing such as shown in FIG. 2(*b*). A latch circuit 16 carries out the time division timing conversion to a low rate such as described above by changing the timing of the key-on signal KON produced in time division from the key assigner 11 to a low rate time division timing such as shown in FIG. 2(*b*). The latch circuits 14 and 16 supply the channel-wise phase data and key-on signals KON with the time division rates changed to low rate time division timings to a tone generation circuit 17. Corresponding to the phase data of the respective channels supplied in time division, the tone generation circuit 17 generates digital amplitude data at the tone waveshape sample point corresponding to that instantaneous phase value in time division for the respective channels and produces the envelope signals on the basis of the key-on signal in time division for the respective channels. With these envelope signals, the circuit 17 controls the digital amplitude values of the respective channels. The newly formed channel-wise digital tone amplitude data is produced in time division from the tone generation circuit 17 according to a low rate time division timing such as shown in FIG. 2(*b*). Thus waveshape sample point amplitude data for one channel is generated once during every x+1 timing slots, where x equals the number of high rate timing slots (e.g. x=8 in FIG. 2(*a*)). The channel-wise digital tone amplitude data produced from the tone generation circuit 17 is applied to a digital-to-analog converter (hereinafter called D/A converter) 18 and converted in time division basis into an analog signal. Because the supplied digital signal for one sample point corresponds to one tone, a smaller number of bits is required of the D/A converter 18 than in the case where the supplied digital signal represents a plurality of added tones so that the D/A converter 18 may have a relatively small-sized hardware structure. Further, in this example, the digital signal applied to the D/A converter 18 has a time width corresponding to the low rate time division timing for one sample point, the D/A converter 18 may be of a low rate processing type corresponding to that low rate timing.

The analog tone signals of the respective channels produced in time division from the D/A converter 18 are applied respectively to a plurality of sample hold circuits 19-1 through 19-8 corresponding to the respective channels. The sample hold circuits 19-1 through 19-8 sample the analog tone signals of the respective channels in response to the channel pulses $CH_i$ (i=1, 2, 3, . . . 8) synchronizing with the low rate time division timings of the respective channels and hold these analog tone signals until the next sampling timings. An example of the channel pulses $CH_i$ is shown in FIG. 2(*d*), wherein at the end of the respective low rate channel timing cycles occur the corresponding channel pulses $CH_1$ to $CH_8$. A typical sample hold circuit, for example, the circuit 19-3, samples the analog tone signal of a third channel through an FET gate 20 in response to the channel pulse $CH_3$, holds that tone signal by a capacitor 21 and delivers it out through a buffer amplifier 22. Thus released from the time division mode, the analog tone signals of the respective channels are applied to an analog adder circuit 24 through sampling circuits 23-1 through 23-8 provided for pitch synchronization and, following the addition, delivered to a sound system 25.

The sampling circuits 23-1 through 23-8 for pitch synchronization are provided to remove the time division timing components which are out of synchronism with the respective pitches of the individual tone signals to be produced. That is, the time division channel timing generally remains constant at all times irrespective of the tone signal pitch and therefore may cause noises which are not in harmony with the tones to be produced. Its influence poses problems particularly in the higher tones. The outputs of the sample hold circuits 19-1 through 19-8, even though released from the time division mode, still contain such inharmonic time division clock components (because of the sample holding synchronized with the time division timing). Hence the output signals of the sample hold circuits 19-1 through 19-8 of the respective channels are allowed to undergo resampling through the sampling circuits 23-1 through 23-8 in synchronism with the pitches of the tones assigned to the respective channels, thereby removing the inharmonic time division clock components.

The phase data generator 13 is used to channel-wise produce the sampling pulse $PS_i$ (i=1, 2, 3, . . . 8) synchronizing with the pitches of the tones assigned to the respective channels. The phase data generator 13 delivers a carry signal CA each time the phase data values of the respective channels change. Because the change rates of the phase data of the respective channels correspond to the frequencies of the tones assigned to the respective channels, the generation periods of the carry signals CA of the respective channels synchronize with the pitches of the tones assigned to the corresponding channels. Because the phase data generator 13 operates in the high rate time division timing (FIG. 2(*a*)), the carry signals of the respective channels are also delivered in the high rate time division timing. A latch circuit 26 channel-wise latches the carry signals CA of the respective channels, which were delivered on the high rate time division timing, in synchronism with the low rate time division timing and holds these signals for one low rate time division cycle. Thus the pulses synchronizing with the pitches of the tones assigned to the respective channels are delivered from the latch circuit 26 channel-wise in parallel, with the pulse width corresponding to one low rate time division cycle and supplied through a delay circuit 27 to the corresponding sampling circuits 23-1 through 23-8 as sampling pulses $PS_i$. The delay circuit 27 is provided to delay the sampling pulses $PS_i$ according to the delay of the tone signals arising between the phase data generator 13 and the sampling circuits 23-1 through 23-8.

An example of the sampling circuit, for instance, the circuit 23-3, consists of an FET gate 28 controlled by the sampling pulse $PS_3$ corresponding to the third channel. The analog adder circuit 24, consisting of resistors R1 through R8 for mixing the outputs of the sampling circuits 23-1 through 23-8 and an integration circuit 29, integrates the analog tone signals of the respective channels sampled in synchronism with the pitches by the integration circuit 29 and adds the analog tone signals of the respective channels.

Figure 3:
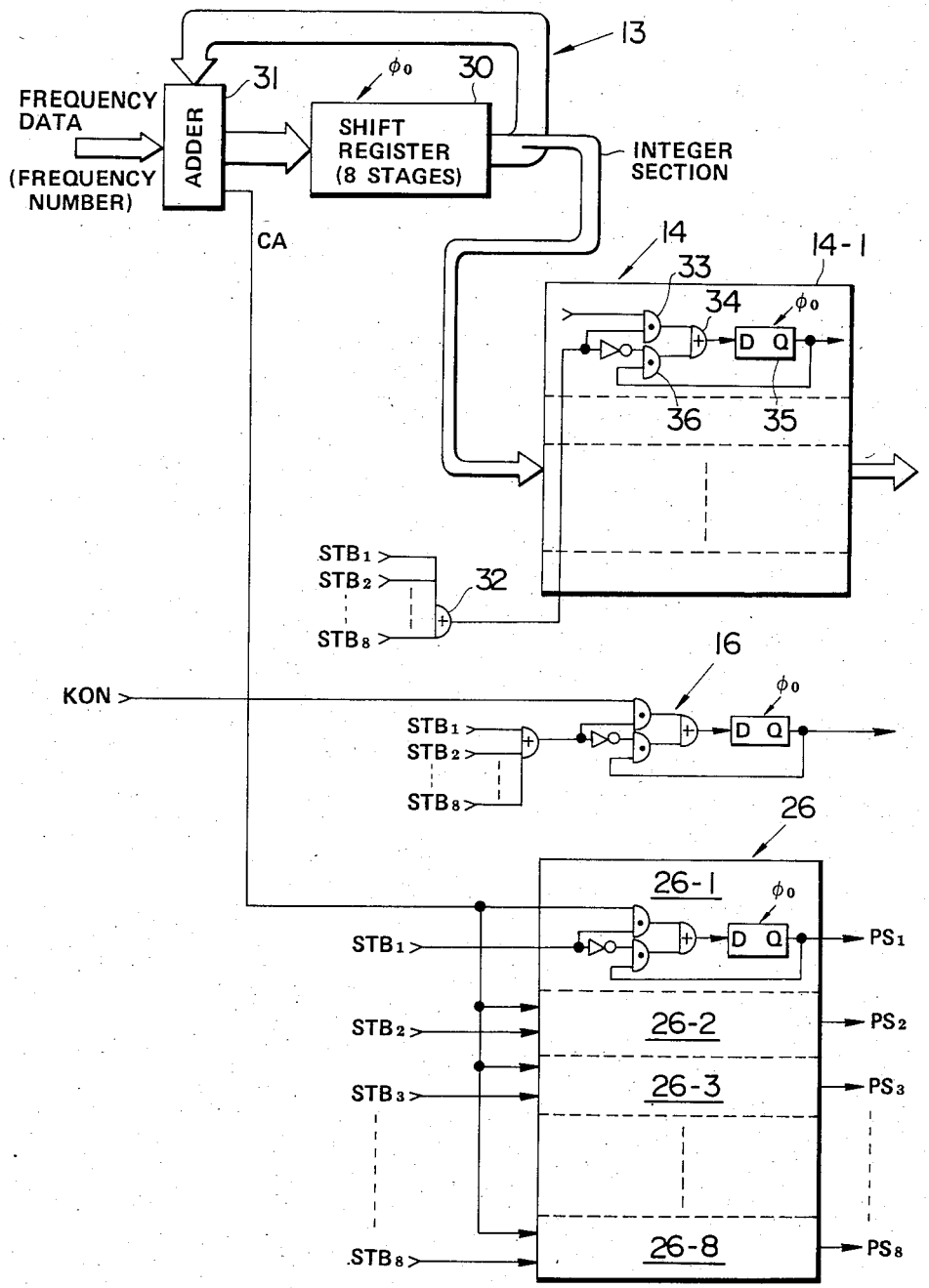
FIG. 3 is a block diagram of a specific example of the time division rate change latch circuit and the phase data generator shown in FIG. 1.

FIG. 3 shows an example in detail of the phase data generator 13 and time division rate change latch circuits 14, 16 and 26. The phase data generator 13 comprises a shift register 30 with stages corresponding in number to the channels and an adder 31 for adding the output of the shift register 30 and the frequency data supplied from the frequency data generator 12, and forms an accumulator which repeatedly adds the frequency data at regular time intervals. In this case, a frequency number indicating a phase increment in unit calculation time is used as the frequency data. This frequency number is numerical data composed of a decimal section and an integer section. Out of the accumulation result produced from the shift register 30, only the integer section data is delivered to the latch circuit 14 as the phase data. When a carry over signal has been given from the decimal section to the integer section following the addition in the adder 31, the carry signal CA is produced. Accordingly the carry signal CA is produced every time the phase data value changes.

The latch circuit 14 has latch units equal in number to the bits of the phase data typically shown by a latch unit 14-1. The strobe pulses $STB_1$–$STB_8$ corresponding to the low rate time division timing of the respective channels are supplied to an OR gate 32 whose output is used as the latch control pulse. An AND gate 33 in the latch unit 14-1 receives one bit of the phase data and the output of the OR gate 32. When any one of the strobe pulses $STB_1$–$STB_8$ is "1", the phase data of the corresponding channel is taken in by the AND gate 33 and applied to a delay flip-flop 35 through an OR gate 34. When the output of the OR gate 32 has become "0", and AND gate 36 is enabled so that the output of the delay flip-flop 35 returns to the input side. Thus the high rate phase data is latched in synchronism with the strobe pulses $STB_1$–$STB_8$ and the time division rate of the phase data is changed to the low rate time division timing.

The latch circuit 26 for forming the sampling pulse $PS_i$ comprises latch units 26-1 through 26-8 like the latch units 14-1 through 14-8 for the respective channels. The carry signal CA is applied in common to the data inputs of the latch units 26-1 through 26-8 while the strobe pulses $STB_1$–$STB_8$ corresponding to the respective channels are applied to the latch control inputs separately. For example, when the carry signal CA has been generated at the high rate time division timing of the first channel, "1" is taken in by the latch unit 26-1 in response to the strobe pulse $STB_1$ and held until the next strobe pulse $STB_1$ is generated. The output of the latch unit 26-1 is used as the sampling pulse $PS_1$ of the first channel. The other latch units 26-2 through 26-8 likewise latch the carry signals of the respective channels for one period of the low rate time division channel timing and deliver those signals as the sampling pulses $PS_2$–$PS_8$.

The latch circuit 16 for the low rate change of the key-on signal KON comprises a latch unit for one bit like the latch unit 14-1 and operates similarly to change the timing of the key-on signal KON to the low rate time division timing.

The phase data generator 13 is not necessarily limited to the type which accumulates the frequency number at regular time intervals but may be of any other type. For example, the generator 13 may be of a type as described in the U.S. Pat. No. 4,442,748 and assigned to the same assignee with the present application, which is supplied, as the frequency data, with frequency division data corresponding to the tone pitches and which produces the phase data by counting the frequency-variable clock pulses corresponding to that frequency division data. Alternatively, the generator 13 may be of a type in which the note clock pulse itself is supplied as the phase data to the tone generation circuit. In this case, the note clock pulse itself may be used as the pitch synchronizing pulse in place of the carry signal CA and the sampling pulse may be generated in response to the note clock pulse.

The tone generation circuit 17 may be of any type, provided that it produces digital tone signals based on the phase data. For example, the generator 17 may be of a type which reads out the tone waveshape data stored in one or more waveshape memories as shown in the U.S. Pat. No. 4,383,462 or of another type which performs tone synthesis by frequency modulation operation as shown in the U.S. Pat. No. 4,018,121.

In FIG. 1, the sampling circuits 23-1 through 23-8 may be altered so as to be similar to the circuits 19-1 through 19-8. In that case, the integration circuit 29 in the analog adder circuit 24 is unnecessary and the mixing resistors R1–R8 suffice.

Also where the sampling circuits 23-1 through 23-8 for pitch synchronization are not provided, the integration circuit 29 in the analog adder circuit 24 is unnecessary and the mixing resistors R1–R8 suffice. Conversely, it is feasible to remove the capacitors 21 and buffer amplifiers 22 of the sample hold circuits 19-1 through 19-8, using instead the hold function of the integration circuit 29.

What is claimed is:

1. An electronic musical instrument comprising:

a keyboard;

key assignment means for assigning a depressed key on said keyboard to one of a plurality of tone generation channels in time division at a first channel timing rate;

tone generation means for generating digital tone amplitude data in time division at a second channel timing rate for each of said channels;

digital to analog conversion means for separately converting said generated tones in time division into corresponding analog signals for each of said channels;

sample and hold means for sampling said analog signals for each of said channels at said second channel timing rate and holding each of the sampled signals for subsequent processing;

pitch synchronization means for sampling each of said analog signals held by said sample and hold means at a channel timing rate corresponding to the pitch of the depressed key associated with said sampled analog signal, and wherein said second channel timing rate is slower than said first channel timing rate.

2. An electronic musical instrument as defined in claim 1 further comprising a system clock for issuing clock pulses, each clock pulse defining one channel timing slot; wherein the number of tone generation channels is eight, said first channel timing rate comprises eight said timing slots and one of said tone generation channels is sampled during each said timing slot, and said second timing rate comprises nine said timing slots and one of said tone generation channels is sampled once during every nine timing slots.

3. A polyphonic electronic musical instrument comprising:

a keyboard;

system clock means for issuing clock pulses, each clock pulse defining one channel timing slot;

key assignment means for assigning a depressed key on said keyboard to one of a plurality of tone generation channels;

phase data generation means operating at a first channel timing rate defined by a predetermined number of said time slots, for generating phase data during each time slot corresponding to frequencies of notes represented by said depressed keys;

waveshape sample point generation means operating at a second channel timing rate, for generating digital waveshape sample point amplitude data for one of said channels once during every x+1 timing slots where x equals said predetermined number of time slots in said first channel timing rate; and digital-to-analog conversion means for converting said digital waveshape sample point amplitude data into corresponding analog signals on a channel-by-channel basis.

4. An electronic musical instrument comprising:

tone selection means for designating a tone to be produced;

assignment means for assigning the tone which has been selected by said tone selection means to an available one of plural tone generation channels each associated with a respective time division time slot;

phase data generation means for generating, in time division, phase data corresponding respectively to frequencies of tones which have been assigned to the respective channels, said generating occurring in every one of the time division time slots associated with said respective channels to which tones have been assigned;

tone generation means for generating, in time division, tone waveshape sample point data in a digital form representing the tones assigned to the respective channels, in response to the phase data of the respective channels supplied in time division from said phase data generation means; and digital-to-analog conversion means provided commonly for the respective channels for individually converting in time division the digital waveshape data of each of the respective channels supplied from said tone generating means into an individual analog signal for each of the respective channels.

5. An electronic musical instrument comprising:

tone selection means for designating a tone to be produced;

assignment means for assigning the tone which has been selected by said tone selection means to an available one of plural tone generation channels;

phase data generation means for generating phase data corresponding respectively to frequencies of tones which have been assigned to the respective channels in a time division multiplexing manner among said plural channels in accordance with a first time division rate;

time division rate conversion means for converting the time division rate of the time division multiplexed phase data into a second time division rate which is lower than said first time division rate;

tone generation means for generating tone waveshape sample point digital data of respective tones assigned to the respective channels, in response to the phase data of the respective channels supplied from said time division rate conversion means; and digital-to-analog conversion means provided commonly for the respective channels for individually converting the digital waveshape data of each of the respective channels supplied from said tone generation means at said second time division rate into individual analog signals for each of the respective channels in a time division multiplexed state.

6. A polyphonic electronic musical instrument comprising:

note designation means for designating a note of a tone to be produced;

assignment means for assigning the note which has been designated by said note designation means to an available one of plural tone generation channels;

phase data generation means for generating phase data corresponding respectively to frequencies of notes which have been assigned to the respective channels in a time division multiplexing manner among said plural channels in accordance with a first time division rate;

time division rate conversion means for converting the time division rate of the time division multiplexed phase data into a second time division rate which is lower than said first time division rate;

tone generation means for generating tone waveshape sample point digital data of respective notes assigned to the respective channels, in response to the phase data of the respective channels supplied from said time division rate conversion means; and digital-to-analog conversion means provided commonly for the respective channels for individually converting the digital waveshape data of each of the respective channels supplied from said tone generation means at said second time division rate into individual analog signals for each of the respective channels in a time division multiplexed state.

7. An electronic musical instrument as defined in claim 6 further comprising:

a plurality of analog memory means provided in correspondence to the respective channels, said analog memory means demultiplexing and holding, channel by channel, the analog waveshape signals for the respective channels supplied in time division from said digital-to-analog conversion means in accordance with said second time division rate; and readout means for reading out the analog waveshape signals held in said analog memory means for the respective channels individually for each of the channels in synchronism with change of the phase data for the respective channels.

8. An electronic musical instrument as defined in claim 7 which further comprises a circuit for generating strobe pulses for the respective channels for establishing time slots of the respective channels in accordance with said second time division rate, and in which said time division rate conversion means latches the phase data of the respective channels provided by said phase data generation means in response to a corresponding one of said channel strobe pulses thereby effecting the conversion into said second time division rate, and said readout means comprises a circuit for generating a readout pulse individually for each of the channels in synchronism with change of the phase data for the respective channels generated by said phase data generation means and at a time slot of each the channels in response to said first time division rate, a circuit for converting timing of generation of the readout pulse of each of the channels into a time slot corresponding to said second time division rate in response to said channel strobe pulse and a circuit for sampling and delivering out the analog waveshape signal from one of said analog memory means corresponding to the particular channel in accordance with the converted readout pulse.

9. An electronic musical instrument comprising:

note designation means for designating a note of a tone to be produced;

assignment means for assigning the note which has been designated by said note designation means to an available one of plural tone generation channels;

phase data generation means for generating phase data corresponding respectively to frequencies of notes which have been assigned to the respective channels;

tone generation means for generating, in time division, tone waveshape sample point data in a digital form representing the notes assigned to the respective channels, in response to the phase data of the respective channels supplied from said phase data generation means;

digital-to-analog conversion means provided commonly for the respective channels for individually converting in time division the digital waveshape data of each of the respective channels supplied from said tone generation means into an individual analog signal for each of the respective channels, a plurality of analog memory means provided in correspondence to the respective channels, said analog memory means sampling and holding, channel by channel, the analog waveshape signals for the respective channels supplied in time division from said digital-to-analog conversions means, and readout means for reading out the analog waveshape signals held in said analog memory means of the respective channels separately for each of the channels in synchronism with the pitches of the notes assigned to the respective channels, and wherein;

said readout means reads out the analog waveshape signals of the respective channels in synchronism with change in the phase data of the respective channels generated by said phase data generation means.

10. An electronic musical instrument as defined in claim 9 further comprising an output circuit which holds and mixes the analog waveshape signal of the respective channels read out by said readout means.

11. An electronic musical instrument as defined in claim 9 further comprising analog adder which accumulates the analog waveshape signals of the respective channels supplied in time division from said digital-to-analog conversion means.

12. An electronic musical instrument as defined in claim 9 wherein said readout means comprises a circuit for generating a readout pulse separately for each of the channels in synchronism with change of the phase data for the respective channels generated by said phase data generation means and a sampling circuit for sampling and delivering out the analog waveshape signal held in one of said analog memory means corresponding to the channel in which the readout pulse has been generated.

13. An electronic musical instrument as defined in claim 12 wherein said phase data generated by said phase data generation means comprises numerical data which repeats change from a certain value to another value at a rate corresponding to the frequency of the note represented by the phase data and said readout pulse generation circuit generates a read out pulse each time the numerical value of the phase data changes.

14. An electronic musical instrument as defined in claim 12 wherein said phase data generation means comprises an accumulator which repeatedly accumulates a frequency number corresponding to the frequency of the note at a regular time interval and generates a carry out signal each time there occurs a carry from a decimal section to an integer section in contents of said accumulator and said readout pulse generation circuit generates the readout pulse in response to the carry out signal.

15. An electronic musical instrument as defined in claim 12 wherein said phase data generation means generates the phase data in response to note clock pulses corresponding to the frequencies of the respective notes assigned to the respective channels and said readout pulse generation circuit generates the readout pulse in response to the note clock pulse of the respective channels.

* * * * *